US008668600B2

(12) United States Patent
Butler

(10) Patent No.: US 8,668,600 B2
(45) Date of Patent: Mar. 11, 2014

(54) FLUTED PUTTER HEAD

(75) Inventor: Byron Butler, Murrieta, CA (US)

(73) Assignee: Butler Cabin Golf, L.L.C., Naples, FL (US)

( * ) Notice: Subject to any disclaimer, the term of this patent is extended or adjusted under 35 U.S.C. 154(b) by 160 days.

(21) Appl. No.: 13/416,887

(22) Filed: Mar. 9, 2012

(65) Prior Publication Data

US 2013/0237342 A1 Sep. 12, 2013

(51) Int. Cl.
*A63B 53/04* (2006.01)
*A63B 53/08* (2006.01)

(52) U.S. Cl.
USPC ..... 473/341; 473/340; 473/336; 473/349; 473/350

(58) Field of Classification Search
USPC ..... 473/336, 340, 341, 349, 350
See application file for complete search history.

(56) References Cited

U.S. PATENT DOCUMENTS

| | | | | |
|---|---|---|---|---|
| 1,517,476 | A | 12/1924 | Tyler | |
| 2,781,197 | A | 2/1957 | Wiley | |
| 3,043,596 | A | 7/1962 | Ehmke | |
| 3,199,872 | A | 8/1965 | Taylor | |
| D209,215 | S * | 11/1967 | Long | D21/736 |
| 3,680,868 | A | 8/1972 | Jacob | |
| D234,209 | S | 1/1975 | Bizovi | |
| 4,000,902 | A | 1/1977 | Perkins | |
| D246,329 | S * | 11/1977 | Little | D21/739 |
| D248,181 | S | 6/1978 | Cervantes | |
| 4,121,832 | A | 10/1978 | Ebbing | |
| 4,199,144 | A | 4/1980 | Skelly | |
| 4,484,746 | A | 11/1984 | Brill | |
| 4,746,124 | A | 5/1988 | Comitz | |
| 4,921,253 | A | 5/1990 | Tesori | |
| 4,960,279 | A | 10/1990 | Harris, Jr. | |
| 4,984,799 | A * | 1/1991 | Finney | 473/341 |
| 5,016,882 | A | 5/1991 | Fujimura et al. | |
| 5,078,398 | A | 1/1992 | Reed et al. | |
| 5,685,784 | A | 11/1997 | Butler | |
| 6,450,894 | B1 * | 9/2002 | Sun et al. | 473/252 |
| 2007/0135231 | A1 * | 6/2007 | Lo | 473/336 |
| 2007/0243943 | A1 * | 10/2007 | Inouye et al. | 473/249 |
| 2008/0020861 | A1 * | 1/2008 | Adams et al. | 473/334 |
| 2011/0177878 | A1 * | 7/2011 | Cole et al. | 473/332 |

* cited by examiner

*Primary Examiner* — Benjamin Layno
(74) *Attorney, Agent, or Firm* — Leonard Tachner

(57) ABSTRACT

A unique golf club putter head having a fluted rear mass design. This rear mass is shaped as a concave mass that merges with the sole of the blade and dips just below the sweet spot of the head at the center thereof. It lowers the center of gravity of the head along the sweet spot while also controlling the mass at heel and toe. Fluting the rear mass permits controlled variation in the distribution of the mass from heel-to-center-to-toe so that it doesn't overwhelm the ball-hitting surface and instead produces stable smooth roll.

10 Claims, 5 Drawing Sheets

FLUTED PUTTER HEAD

BACKGROUND OF THE INVENTION

1. Field of the Invention

The present invention relates generally to the field of golf clubs and more specifically to an improved golf club putter head having a unique configuration that favorably alters feel and sound as the putter face strikes the golf ball.

2. Prior Art

There are literally hundreds of U.S. Patents disclosing golf club putter heads. The following list is just a small sample of such patents.

| | |
|---|---|
| DES. 234,209 | Bizovi |
| DES. 248,181 | Cervantes |
| 1,517,476 | Tyler |
| 2,781,197 | Wiley |
| 3,043,596 | Ehmke |
| 3,199,872 | Taylor |
| 3,680,868 | Jacob |
| 4,000,902 | Perkins |
| 4,121,832 | Ebbing |
| 4,199,144 | Skelly |
| 4,484,746 | Brill |
| 4,746,124 | Comitz |
| 4,921,253 | Tesori |
| 4,960,279 | Harris, Jr. |
| 5,016,882 | Fujimura et al |
| 5,078,398 | Reed et al |
| 5,685,784 | Butler |

None of these patents discloses a putter head having a fluted rear mass design which adds to a stable ground-hugging roll of the golf ball toward the hole and which provides a unique ball impact sound and improved feel.

SUMMARY OF THE INVENTION

The present invention comprises a unique golf club blade-style putter head having a fluted rear mass design which provides important advantages. Because this rear mass is shaped as a concave mass that merges with the sole of the blade and dips just below the sweet spot of the head at the center thereof, it provides a significant benefit in ball control. It lowers the center of gravity of the head along the sweet spot while also desirably controlling the mass at heel and toe. A lower center of gravity keeps the height of the hitting surface more consistently at a position that is likely to be precisely aligned vertically with the golf ball to result in a truer, more stable, consistent roll toward the hole. The controlled heel and toe mass lowers the risk of twisting of the head during the putting stroke which could otherwise produce a wayward impact that would inadvertently skew the ball to the left or right of the hole.

Fluting the rear mass also produces benefits. It permits controlled variation in the total weight of the mass from heel-to-center-to-toe so that it doesn't overwhelm the ball-hitting surface and instead produces stable smooth roll. Moreover, it affects the characteristics of the ball striking acoustics and feel which some golfers find both pleasant and confidence building in their putting regime. The result is an improved golf club putter head having a low center of gravity at the sweet spot, a more stable ball roll, a pleasant impact sound and feel and a truer sense of ball control.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
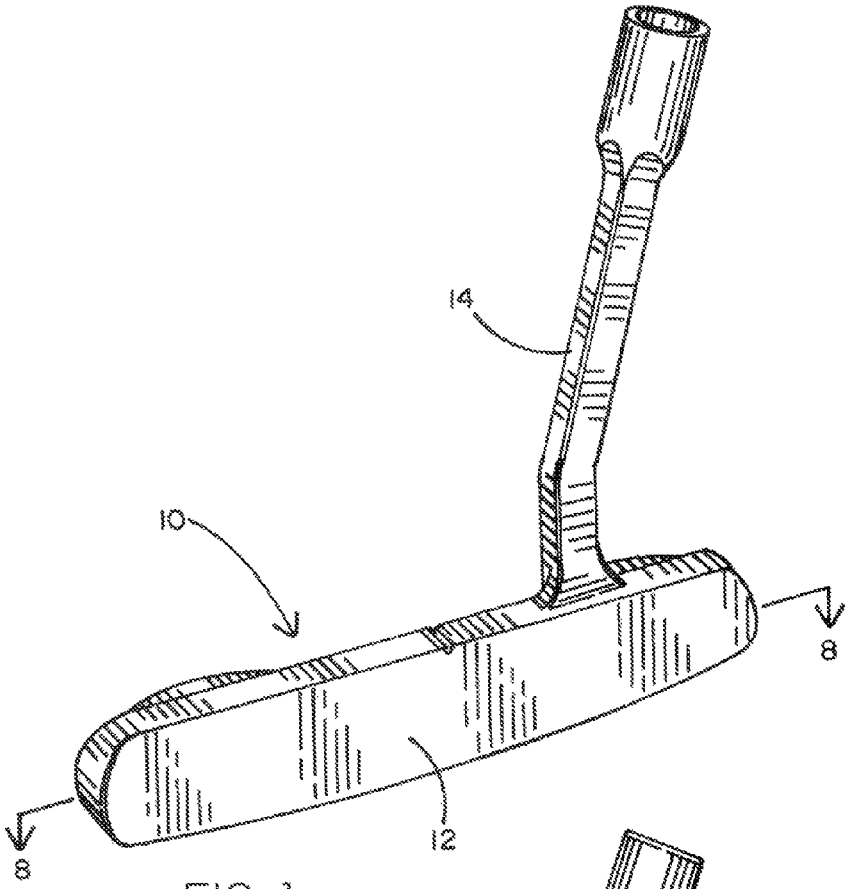
FIG. 1 is a three-dimensional view of a preferred embodiment of a fluted blade putter head in accordance with the present invention.
Figure 2:
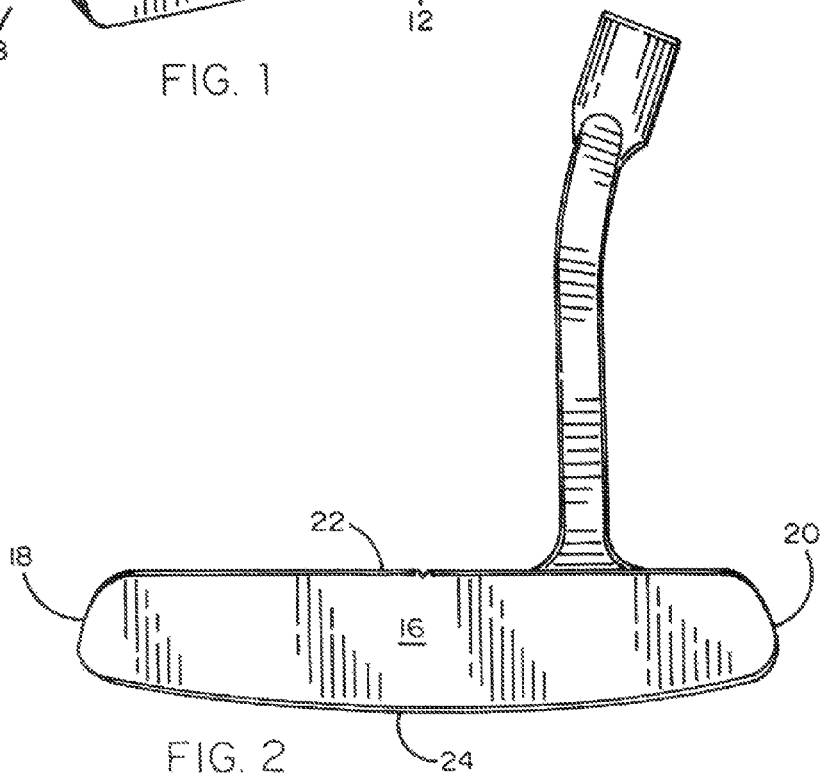
FIG. 2 is a front elevation view thereof.
Figure 3:
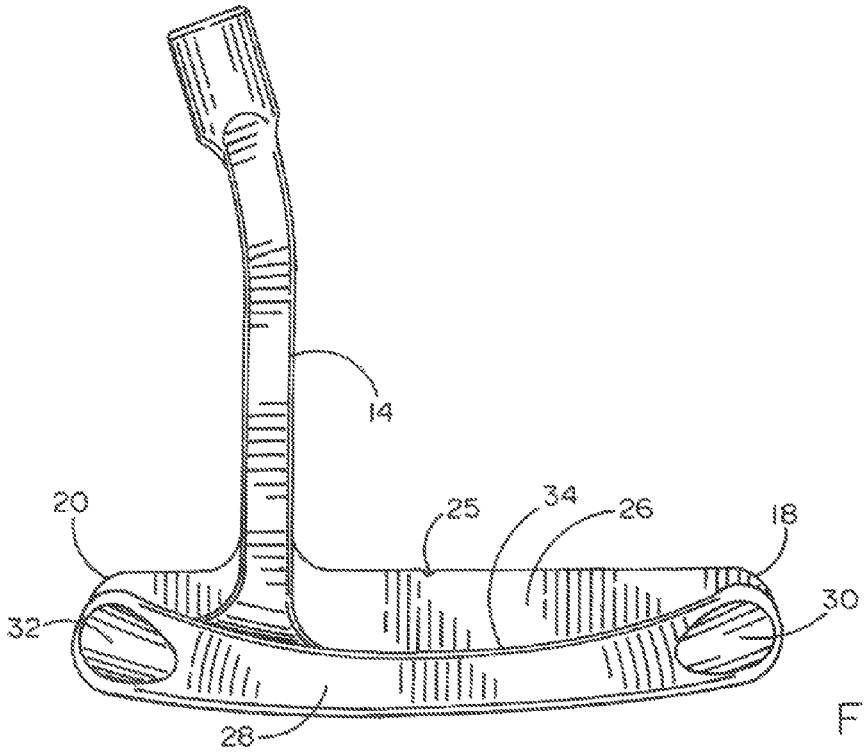
FIG. 3 is a rear elevation view thereof.
Figure 4:
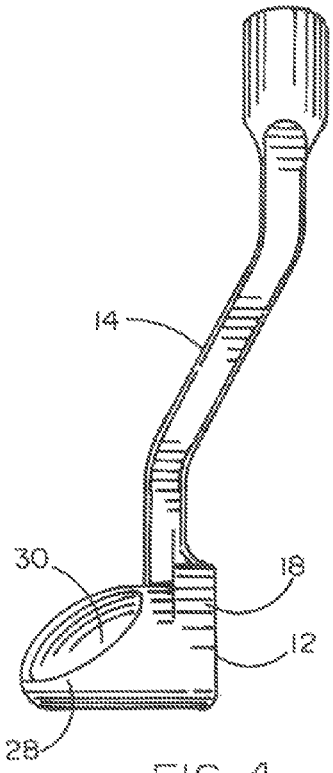
FIG. 4 is a right side view thereof.
Figure 5:
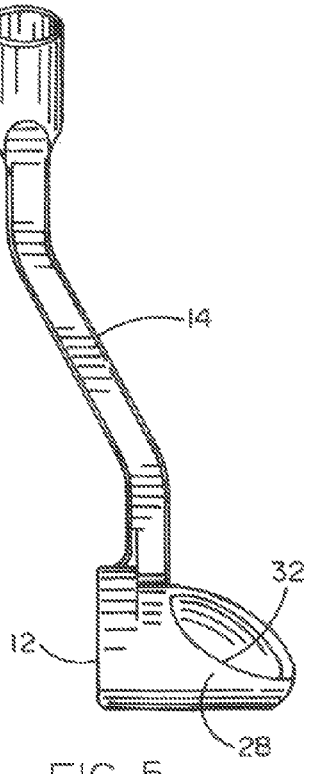
FIG. 5 is a left side view thereof.
Figure 6:
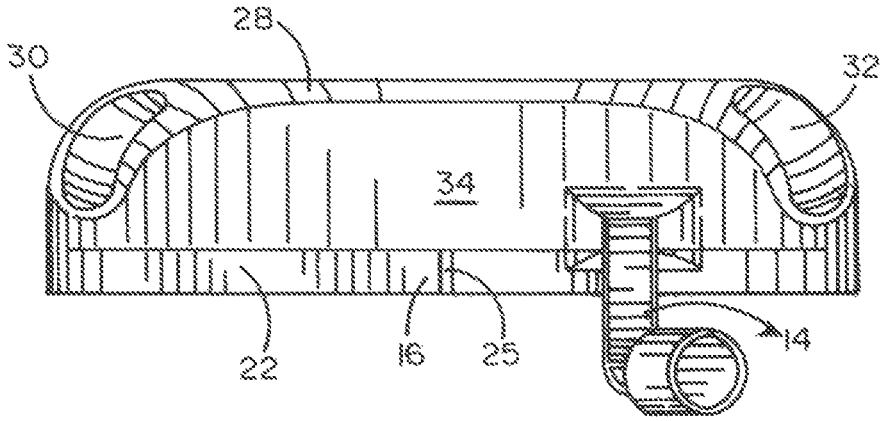
FIG. 6 is a top view thereof.
Figure 7:
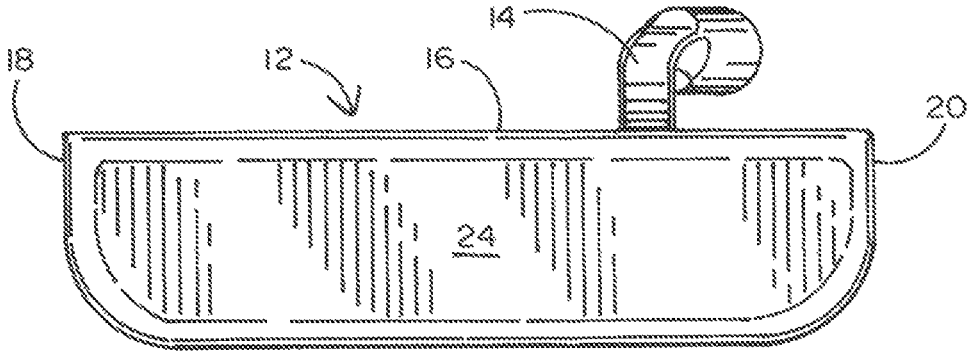
FIG. 7 is a bottom view thereof.
Figure 8:
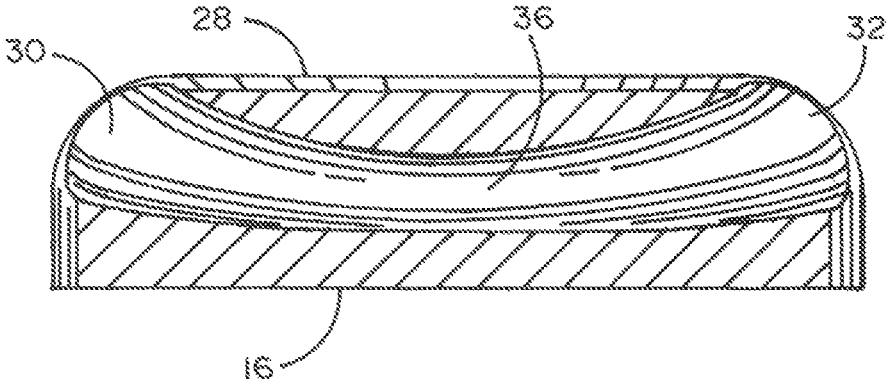
FIGS. 8-12 are respective cut-away views of the fluted rear mass of the illustrated embodiment taken along downward directed lines 8-8 of FIG. 1 and along various horizontal cuts in FIG. 9 corresponding to FIGS. 10-12.
Figure 9:
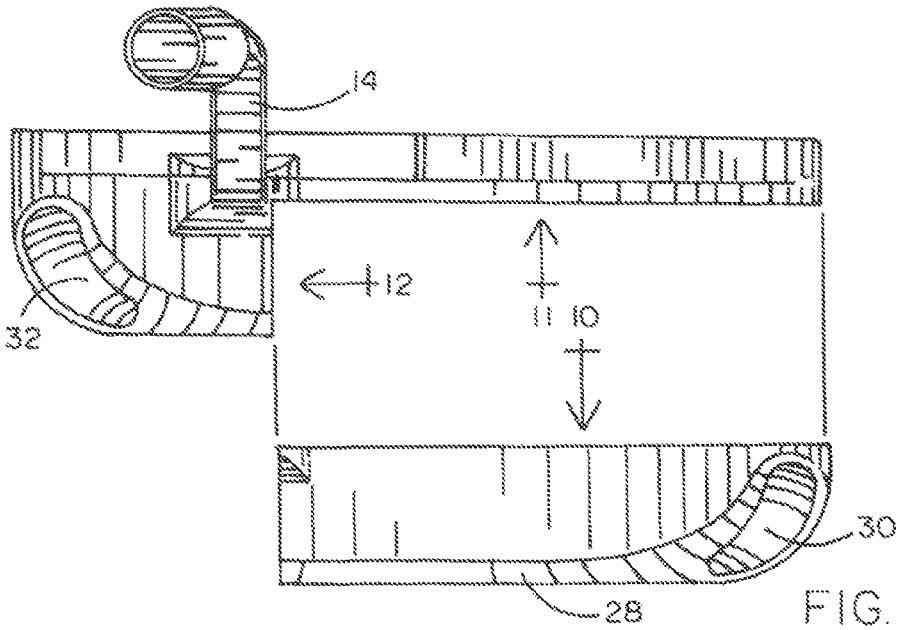
Figure 10:
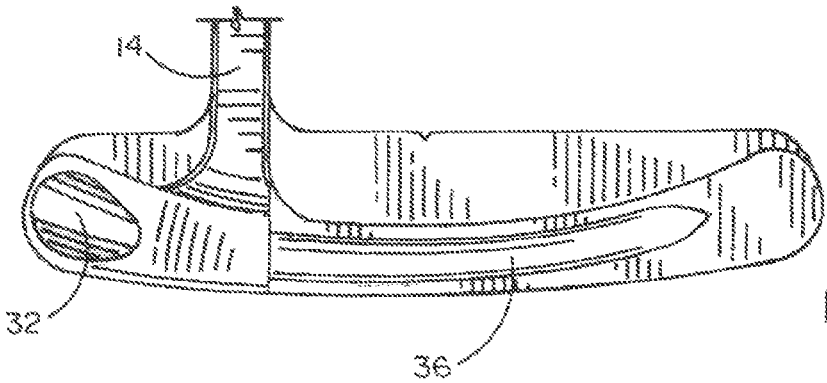
Figure 11:
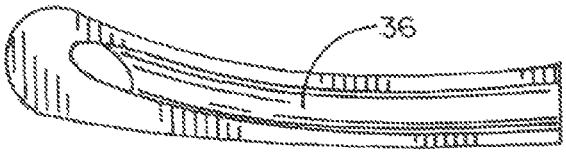
Figure 12:
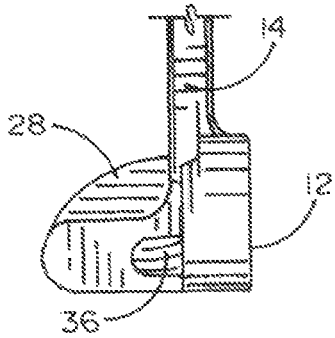

Turning to the accompanying FIGS. 1 through 12, it will be seen that a blade putter head 10 in accordance with a preferred embodiment hereof, comprises a body 12 and a hose 14. Body 12 has a face or hitting surface 16 formed by a toe 18, a heel 20, a topline 22 and a sole 24. Topline 22 provides a center notch 25 to aid in ball alignment. The back 26 of the body 12 merges integrally with rear mass 28 which extends laterally from toe 18 to heel 20 and vertically from an upper concave surface 34 to the bottom surface 24 where it is perfectly flush with the sole of the body 12. The center or perigee of concave surface 34 falls just below what is the sweet spot of face 16 projected back through the body to back surface 26 as seen best in FIG. 3.

Mass 28 is fluted from heel to toe, opening into a toe flute aperture 30 and a heel flute aperture 32 as seen best in FIGS. 3 through 6. The entire flute 36 (see FIG. 8) is curved and bi-directionally and symmetrically tapered in the horizontal plane with the narrowest point at the center and the widest points at the apertures 30 and 32. The flute's curvature is both in the lateral toe to heel direction and in the front to back direction of the mass 28. The principal purpose of mass 28 is to add structure to the putter head in a controlled manner which a) lowers the center of gravity behind the sweet spot; b) controls weight distribution between the to and heel; and c) improves sound and feel at ball impact. The center of gravity is lowered at the sweet spot by curving the mass so that concave surface 34 is below that spot. Heel and toe weight is controlled by expanding mass 28 in height as it approaches the heel and toe of the body. Control of weight distribution is further facilitated by both the outer geometry of the mass 28 and by the size, taper shape and curvature of the flute 36 including apertures 30 and 32. As seen best in FIGS. 9-12, the flute 36 has a relatively uniform channel dimension in the vertical plane while being sufficiently curved to lower the height of the mass 28 behind the sweet spot.

An additional benefit of the flute mass 28 is the sound that it generates when a golf ball is struck by the putter head 10. This sound is somewhat like a distinct tone which appears to be amplified by the shape and geometry of the flute 36 and by the shape and location of flute apertures 30 and 32.

It will now be understood that what has been disclosed herein is a unique golf club putter head having a fluted rear mass integrated with the body forming the hitting surface.

Because this rear mass is shaped as a concave mass that merges with the sole of the blade and dips just below the sweet spot of the head at the center thereof, it provides a significant benefit in ball control. It lowers the center of gravity of the head along the sweet spot while also desirably distributing the mass between heel and toe. A lower center of gravity keeps the height of the hitting surface more consistently at a position that is likely to be precisely aligned vertically with the golf ball to result in a truer, more stable, bounce-free roll toward the hole. The controlled mass between heel and toe lowers the risk of twisting of the head during the putting stroke which could otherwise produce a wayward impact that would inadvertently skew the ball to the left or right of the hole.

Fluting the rear mass also produces benefits. It permits controlled variation in the total weight of the mass from heel-to-center-to-toe so that it doesn't overwhelm the ball-hitting surface and instead produces stable smooth roll. Moreover, it affects the characteristics of the ball striking acoustics and feel which some golfers find both pleasant and confidence building in their putting regime. The result is an improved golf club putter head having a low center of gravity at the sweet spot, a more stable ball roll, a pleasant impact sound and feel and a truer sense of ball control.

Those having skill in the art of golf club design will, as a result of the disclosure herein, now perceive of various modifications and variations that may be made to the disclosed embodiment. However, it should be understood that such changes may still be deemed to be within the scope hereof which is not limited by the disclosed embodiment, but only by the appended claims and their legal equivalents.

I claim:

1. A golf club putter head comprising:

a body portion configured as a blade head having a hitting surface defined by a topline, a sole, a heel and a toe and said body portion having a rear surface, said hitting surface having a sweet spot;

a rear mass integrally extending rearwardly from said rear surface from said heel to said toe, said mass being substantially of a symmetrical concave shape and having a perigee at a location corresponding to a point beneath said sweet spot and having a bottom surface flush with said sole of said body portion;

said rear mass being fluted to form a channel along its entire length from said heel to said toe.

2. The golf club putter head recited in claim 1 wherein said channel is curved.

3. The golf club putter head recited in claim 1 wherein said channel is tapered.

4. The golf club putter head recited in claim 1 wherein said channel is both curved and tapered.

5. The golf club putter head recited in claim 1 wherein said channel opens into respective apertures at said heel and said toe.

6. The golf club putter head recited in claim 1 wherein said rear mass is configured to lower the center of gravity of said head to a location that is between said sweet spot and said sole.

7. The golf club putter head recited in claim 1 wherein said fluted rear mass is configured to affect the sound of the hitting surface striking a golf ball.

8. The golf club putter head recited in claim 1 wherein said fluted rear mass is configured to control weight distribution between heel and toe.

9. The golf club putter head recited in claim 1 wherein said channel has a smallest dimension adjacent said sweet spot.

10. The golf club putter head recited in claim 1 wherein said channel has a largest dimension at said heel and at said toe.

* * * * *